US005408222A

United States Patent [19]

Yaffe et al.

[11] Patent Number: 5,408,222

[45] Date of Patent: Apr. 18, 1995

[54] DEVICE FOR WARNING WHEN A PERSON IS SUBMERGED BENEATH WATER

[76] Inventors: Yacob Yaffe, 1 Levi Eshkol Str., Yehud 56253; Amos Zur, 6 Huberman St., Petach Tikva 49353, both of Israel

[21] Appl. No.: 120,121

[22] Filed: Sep. 10, 1993

[51] Int. Cl.[6] ..... G08B 21/00

[52] U.S. Cl. ..... 340/604; 340/573; 340/539; 455/344

[58] Field of Search ..... 340/604, 573, 539, 603, 340/618, 620; 200/61.04; 455/344, 347

[56] References Cited

U.S. PATENT DOCUMENTS 4,549,169 10/1985 Moura et al. ..... 340/573 X
4,714,914 12/1987 Boe ..... 340/573
4,727,599 2/1988 Rappaport et al. ..... 455/347 X
4,747,085 5/1988 Dunegan .
5,029,293 7/1991 Fontanille ..... 340/573
5,030,152 7/1991 Carr et al. ..... 340/604 X
5,043,705 8/1991 Rooz .
5,059,952 10/1991 Wen ..... 340/573

*Primary Examiner*—Jeffery A. Hofsass

[57] ABSTRACT

A device for warning when a person is submerged beneath water, comprising a timing circuit having first and second terminals and being responsive to a voltage applied to the first terminal for connecting the second terminal to the first terminal after a predetermined time interval and an alarm unit connected to the second terminal of the timing circuit. A normally open water-sensitive switch is provided for attaching to a part of the person's body which is normally above water and is coupled to the first terminal of the timing circuit. An electrical supply is coupled to the water-sensitive switch for applying the required voltage to the first terminal of the timing circuit when the water-sensitive switch is submerged beneath water. A normally deflated float may be worn by the person so as to be automatically inflated in response to the alarm signal.

19 Claims, 5 Drawing Sheets

DEVICE FOR WARNING WHEN A PERSON IS SUBMERGED BENEATH WATER

FIELD OF THE INVENTION

This invention relates to a device for warning when a person is submerged beneath water.

BACKGROUND OF THE INVENTION

When a person sinks to the bottom of a pool of water, or even floats unconscious on the surface of the water, his lungs stop functioning and his brain is therefore deprived of oxygen. If this situation is allowed to continue for more than a few minutes, irreparable damage will be done to the brain even if the person is resuscitated. However, if the drowning person is detected quickly and removed from the water, there is still a very short time period during which resuscitation may be effected before permanent damage ensues. Thus, rapid detection and identification of a drowning body is essential if resuscitation is to be at all possible and if permanent damage is to be avoided.

Clearly, detection of a drowning body which remains floating on the surface of the water may easily be effected manually by means of a life-guard, when present. Consequently, effort has generally been expended into detecting a drowning body which is submerged beneath the surface of the water. Most prior art devices are based on detecting disturbances in the water and actuating a suitable alarm when such disturbances are detected. Such an approach may also be used in order to monitor unauthorized entry into a swimming pool and to provide an alarm in the event of such unauthorized entry.

Thus, for example, U.S. Pat. No. 4,747,085 (Dunegan) discloses a swimming pool alarm system for actuating an alarm in response to the movement of a person in a swimming pool. The system includes a transmitter mounted below the surface of the swimming pool for continuously transmitting ultrasonic sound waves through the body of water, and a similarly positioned receiver detects sound waves in the water and generates an electrical signal in response thereto. The electrical signal is continuously monitored, and the movement of a person in the pool alters the received ultrasonic sound waves and the corresponding electrical signal so as to produce a corresponding alarm signal.

The device disclosed by Dunegan et at., and which is typical of its genre, is based on the assumption that a drowning person struggles violently prior to sinking and therefore gives rise to disturbances in the water which can be monitored.

In contrast to such an approach, U.S. Pat. No. 5,043,705 (Rooz et al.) discloses a system for detecting a motionless body in a pool consequent to a swimmer sinking to the bottom of the pool, usually after losing consciousness. In such circumstances, the swimmer no longer moves and therefore detection based on monitoring disturbances in the water is no longer possible. The system disclosed by Rooz et al. is based on scanning the lower surface of the pool so as to extract successive frames of image data which are analyzed in order to detect a contour of a body which remains substantially motionless for longer than a predetermined time interval.

There are drawbacks associated with both of the above-mentioned approaches. Thus, devices of the type described by Dunegan et al. are intended to provide a warning in the event of unauthorized disturbances within the swimming pool. Such systems are effective only when the pool is empty. People swimming in the pool inevitably cause disturbances which require that the alarm systems of the type described by Dunegan et al. be disabled in order to prevent them from operating. In other words, alarm systems of this type are primarily intended to protect domestic swimming pools or even public swimming pools when not in use and the lifeguard is not present.

The purpose of such alarm systems is generally to protect against unforeseen slipping in the water and to provide a warning that someone has entered the pool when it is, as yet, unauthorized for use. Such an approach is obviously important to guard against small children slipping into the water or against somebody who falls in when it is dark and cannot climb out unaided.

The fact that such devices must be disabled when use of the pool is authorized, severely militates against their use for detecting a swimmer in distress. Such a drawback is overcome by the system disclosed by Rooz et al., but their system is sophisticated and therefore expensive.

Yet another drawback associated with all systems of the type described is that they must somehow be mounted in conjunction with the swimming pool itself. Thus, specifically, there are provided ultrasonic transmitters and detectors which must be affixed to the pool. This might possibly be acceptable for domestic pools, but provides insufficient protection for a member of the public who may swim regularly at different pools. Unless each pool is protected by a suitable monitoring device which is enabled when the pool is open to the public, the resulting protection is inadequate.

Such a drawback would, of course, be overcome if the detection means typically associated with prior art systems were somehow associated not with the pool but rather with the swimmer himself. No such approach has been contemplated in hitherto proposed systems.

SUMMARY OF THE INVENTION

It is an object of the invention to provide a device for warning when a person is submerged beneath water, in which the drawbacks associated with hitherto proposed systems are significantly reduced or overcome.

According to a broad aspect of the invention there is provided a device for producing a warning signal when a person is submerged beneath water, the device comprising:

- a timing means having first and second terminals and being responsive to a voltage applied to the first terminal for connecting the second terminal to the first terminal after a predetermined time interval,
- a signalling unit connected to the second terminal of the timing means and responsive to the voltage thereon for producing said warning signal,
- a normally open water-sensitive switch for attaching to a part of the person's body which is normally above water and being coupled to the first terminal of the timing means, and
- an electrical supply coupled to the water-sensitive switch for applying said voltage to the first terminal of the timing means when the water-sensitive switch is submerged beneath water.

In accordance with a preferred embodiment of the invention, the signalling unit is part of an alarm unit comprising a transmitter worn by the person for transmitting a warning signal after he is submerged for a predetermined time interval and a receiver remote from the person for receiving the warning signal and producing an alarm signal. An alarm indication means is coupled to the receiver and is responsive to the alarm signal for producing an audible or visual warning.

BRIEF DESCRIPTION OF THE DRAWINGS

In order to understand the invention and to see how the same may be carried out in practice, some preferred embodiments will now be described, by way of non-limiting example only, with reference to the accompanying drawings, in which.

DETAILED DESCRIPTION OF PREFERRED EMBODIMENTS

Figure 1:
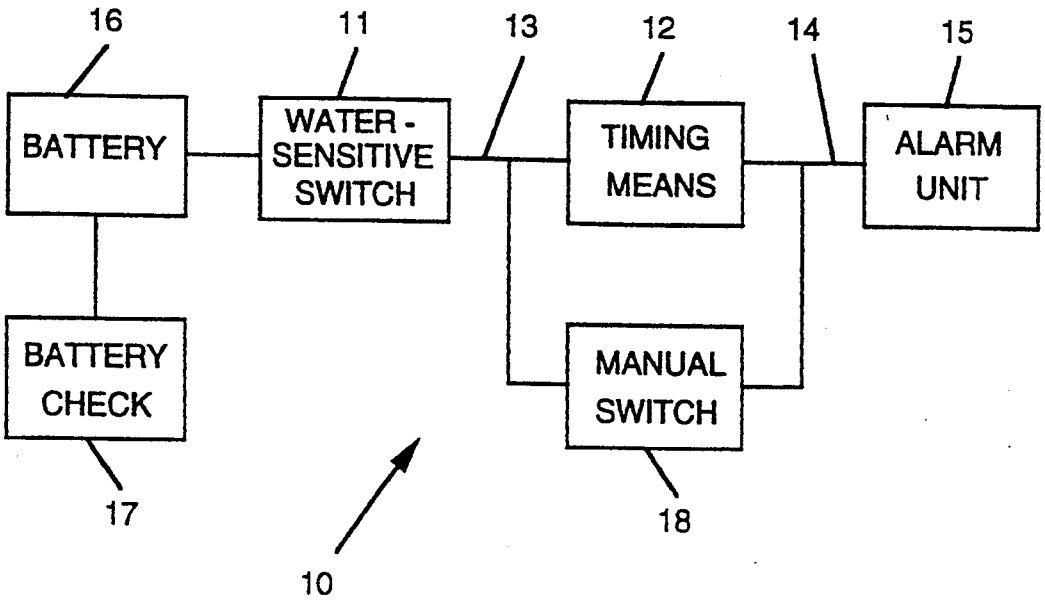
FIG. 1 is a block diagram showing functionally the principal components of a system according to the invention.

FIG. 1 shows a device depicted generally as 10 comprising a water-sensitive switch 11 for attaching to a part of a person's body which is normally above water such as, for example, his forehead. A timing means 12 has a first terminal 13 connected to one contact of the water-sensitive switch 11 and a second terminal 14 connected to an alarm unit 15. A battery 16 is connected to a second contact of the water-sensitive switch and to a battery check circuit 17. A normally-open manual switch 18 is connected across the first and second terminals 13 and 14, respectively, of the timing means 12, for short-circuiting the timing means 12, if required.

The device operates as follows. The battery 16 provides a predetermined voltage which is insulated from the first terminal 13 of the timing means 12 so long as the water-sensitive switch 11 remains open (i.e. its normal state). However, when the water-sensitive switch 11 is submerged beneath water, the normally-open contacts thereof close, thereby applying the battery voltage to the first terminal 13 of the timing means 12. The timing means 12 is constructed to connect the first and second terminals 13 and 14, respectively, after a predetermined time interval which may be pre-set within the range 40 to 60 sec. Thus, upon submerging the water-sensitive switch 11 beneath water and maintaining it beneath water for the pre-set time interval, the battery voltage 16 is applied, via the water-sensitive switch 11 and the timing means 12, to the second terminal 14 of the timing means 12 and hence to the alarm unit 15. Typically, the alarm unit 15 provides an audible sound which alerts a life-guard, or a neighboring swimmer, that the person wearing the device is in distress.

The battery check 17 is typically provided with an indicator lamp for providing an indication that the battery voltage is sufficiently high to permit effective operation of the device.

The manual switch 18 short-circuits the timing means 12, thereby activating the alarm unit 15 whenever the water-sensitive switch 11 is submerged beneath the water, regardless of the elapsed time during which the water-sensitive switch 11 has been submerged. Thus, the manual switch 18 is useful for divers, for example, and other similar underwater swimmers who, by means of the manual switch 18, are able to send distress signals when their oxygen supply is short, or for any other reason, regardless of the status of the timing means 12.

Figure 2:
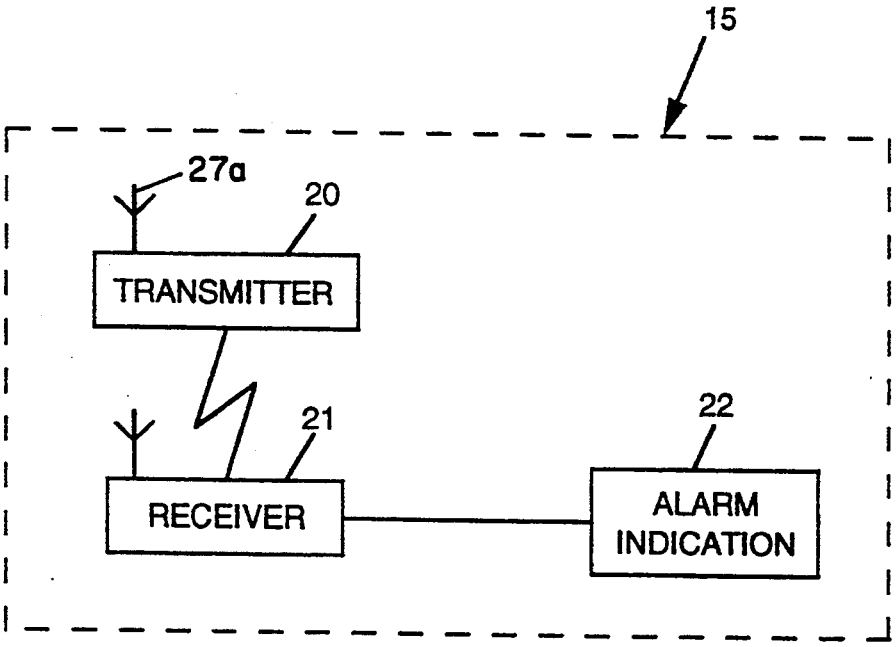
FIG. 2 is a block diagram showing functionally the principal components of an alarm unit in accordance with a first embodiment of the invention.

FIG. 2 shows a detail of the alarm unit 15 in accordance with a first preferred embodiment of the invention. There is provided a transmitter 20 which is worn by the swimmer and transmits a warning signal when the first and second terminals 13 and 14, respectively, of the timing means 12 are connected to each other. A receiver 21, remote from the transmitter 20 and typically fixed to a swimming pool (see FIG. 3), receives the warning signal and produces a corresponding alarm signal which, in turn, is fed to an alarm indication means 22 for producing the desired warning.

Alternatively, the alarm unit 15 may be constituted by a simple alarm circuit, including a buzzer, which is connected directly to the timing means 12.

Figure 3:
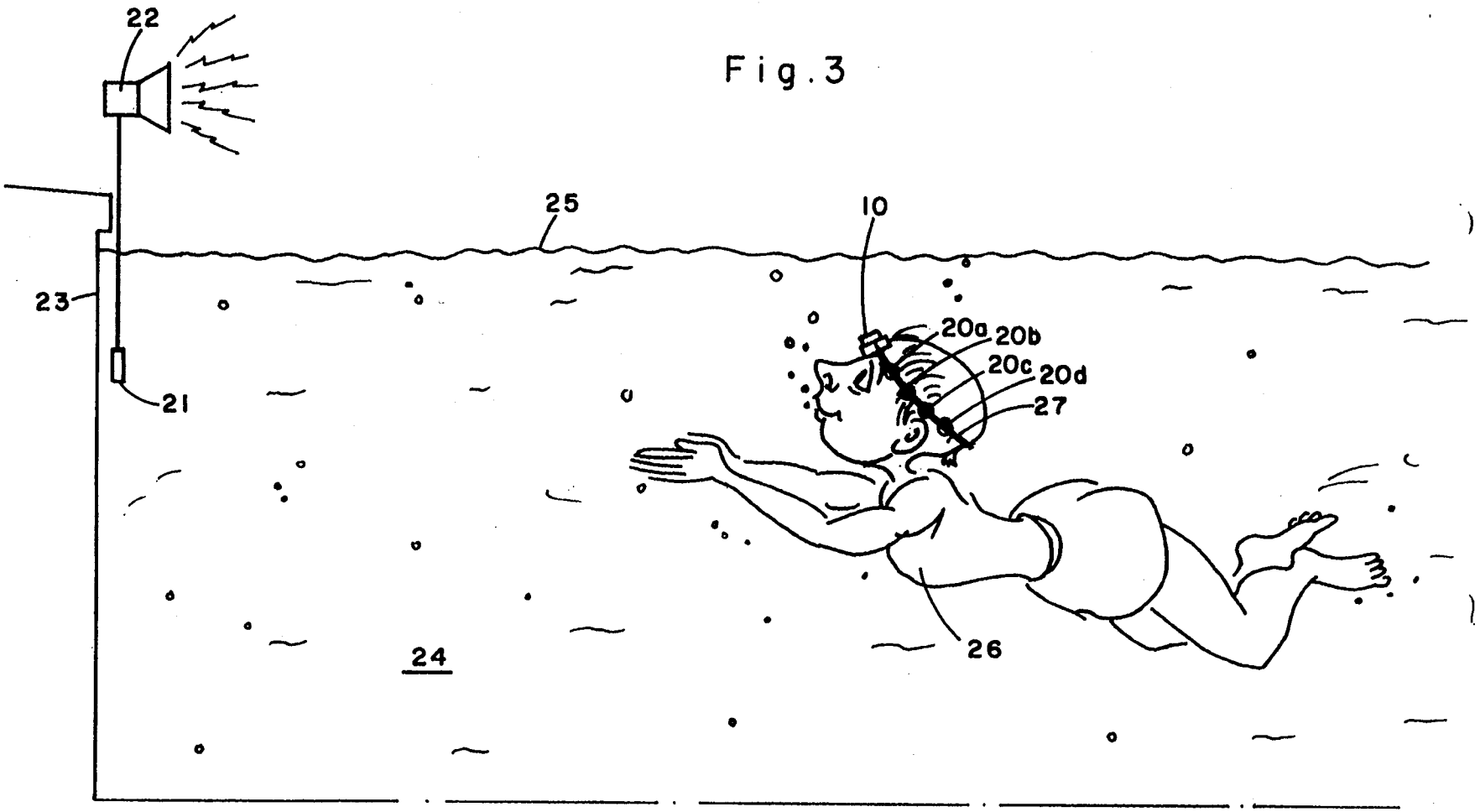
FIG. 3 is a pictorial representation of a swimmer employing the device according to the first embodiment.
Figure 4:
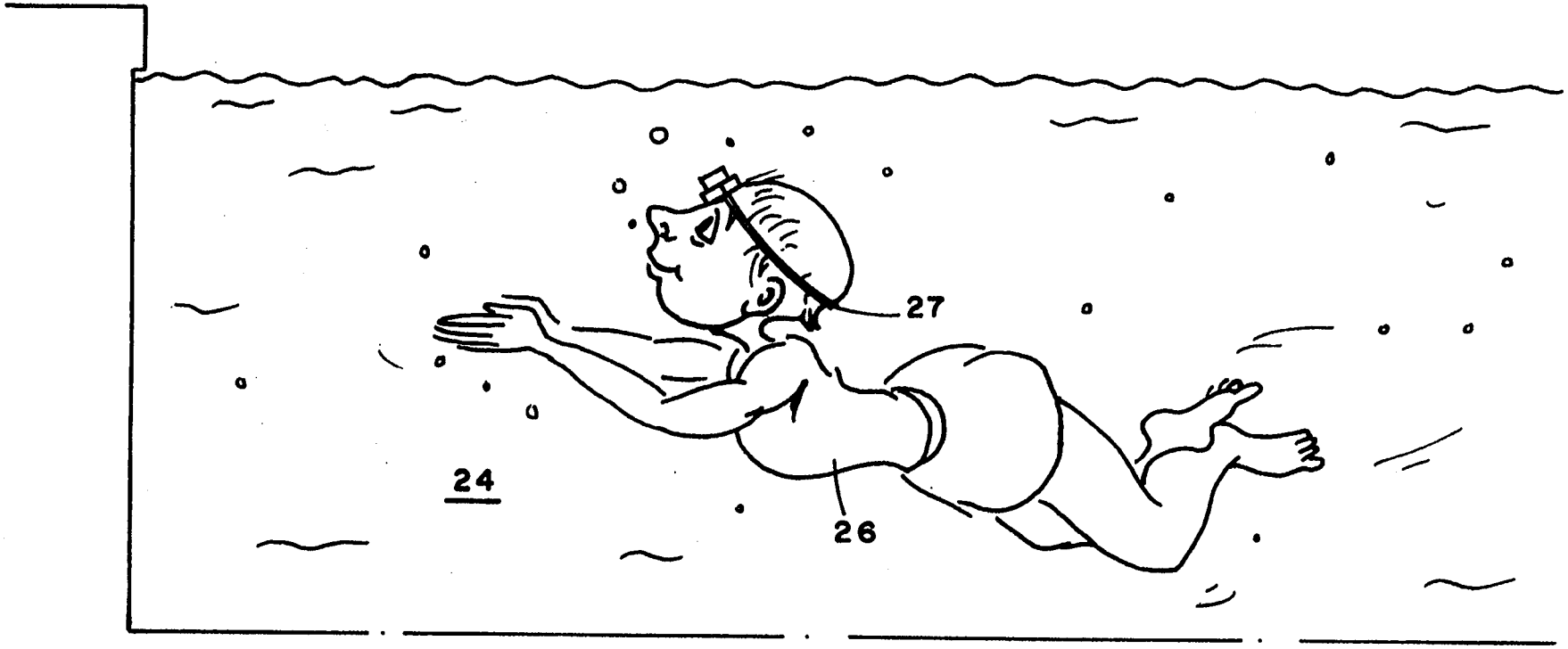
FIG. 4 is a pictorial representation of a swimmer using the device in accordance with a second embodiment.

FIGS. 3 and 4 show alternative scenarios of the device 10 in actual use. Thus, as shown in FIG. 3, the receiver 21 is fixed to a wall 23 of a swimming pool 24 beneath the level 25 of water therein. The alarm indication means 22 is fixed above the water level 25. A swimmer 26 wears the device 10 around his forehead, the device 10 being fixed thereto by means of a flexible headband 27. When the swimmer 26 is submerged beneath the water level 25 for longer than the pre-set time interval, the transmitter 20 emits a warning signal, this being detected by the receiver 21, so as to produce an audible or visual alarm signal via the alarm indication means 22.

The transmitter 20 is typically directional, thereby permitting the warning signal transmitted thereby to be detected only by a receiver 21 which is located within a reception zone of the transmitter 20. Therefore, for large pools, a plurality of receivers 21 may be provided around a periphery of the pool, each of the receivers being connected either to a common alarm indication unit or, alternatively, to separate alarm indication units, as required. The provision of a separate alarm indication unit for each receiver, provides immediate feedback to a lifeguard or other security personnel of the approximate direction from which the warning signal was transmitter and hence in which the swimmer 26 is located.

The warning signal may be acoustic such as ultrasonic, optical such as infra-red or a radio-frequency (r.f.) signal. In the event that r.f. signals are employed, an antenna may be connected to the transmitter 20, the antenna preferably being constituted by a flexible electrically conductive belt which may also serve as the headband 27 and 27*a*. Alternatively, several transmitters 20*a*–20*d* may be disposed circumferentially round the headband 27, each for transmitting a respective acoustic, optical or r.f. signal, as required to a corresponding receiver.

FIG. 4 shows a second embodiment wherein the alarm unit is integral with the device itself and, again, is worn by the swimmer 26 around his forehead by means of the headband 27. In this case, the alarm unit 15 provides an audible signal which may be heard from outside of the pool 24 in order to alert a life-guard; or, indeed, may be heard from within the pool by a neighboring swimmer.

In order to render the device attractive, particularly to young children, the headband 27 may be covered with a decorative material.

Figure 5:
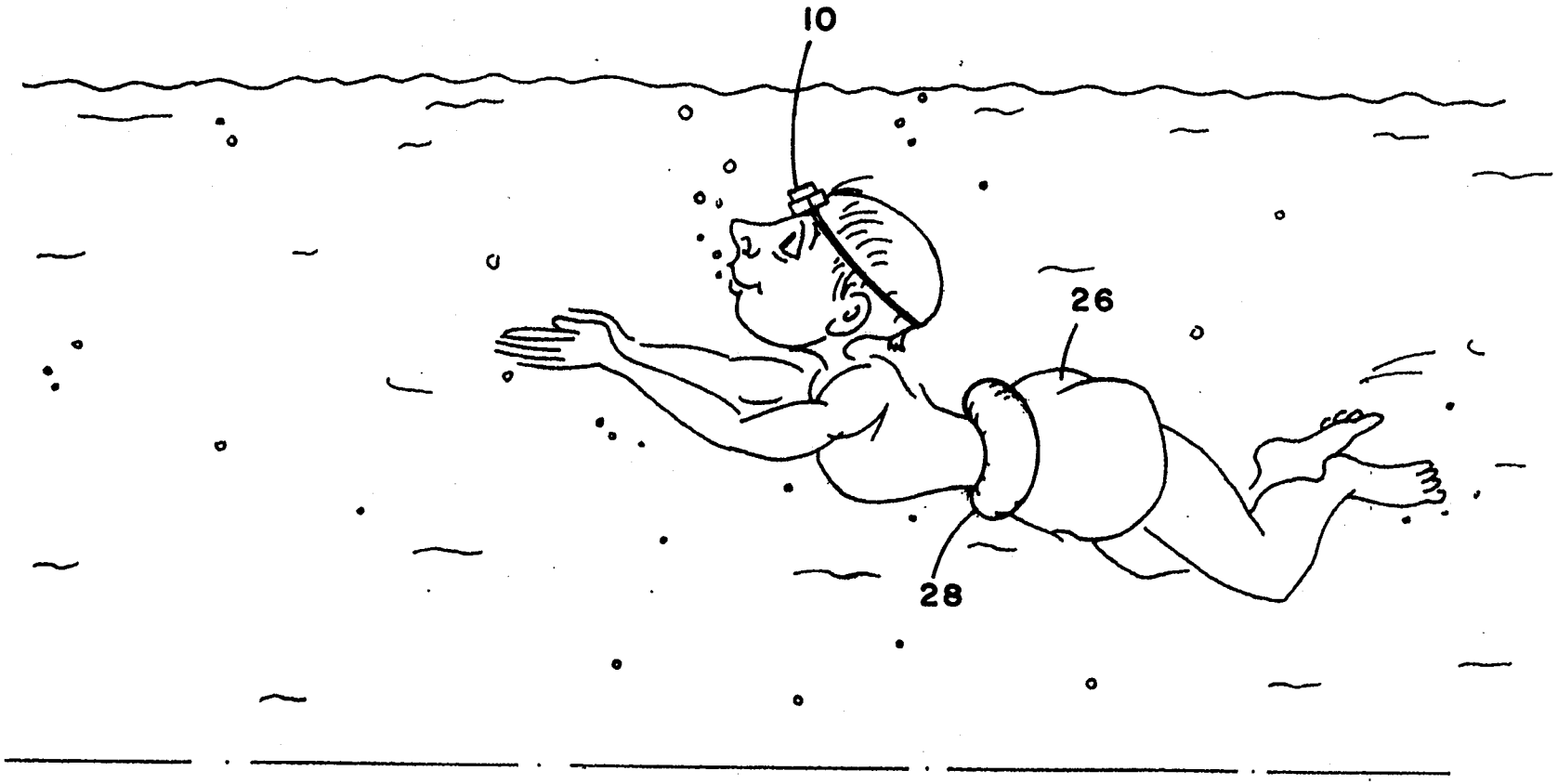
FIG. 5 is a pictorial representation of a swimmer using the device in accordance with a third embodiment for automatically inflating a float.
Figure 6:
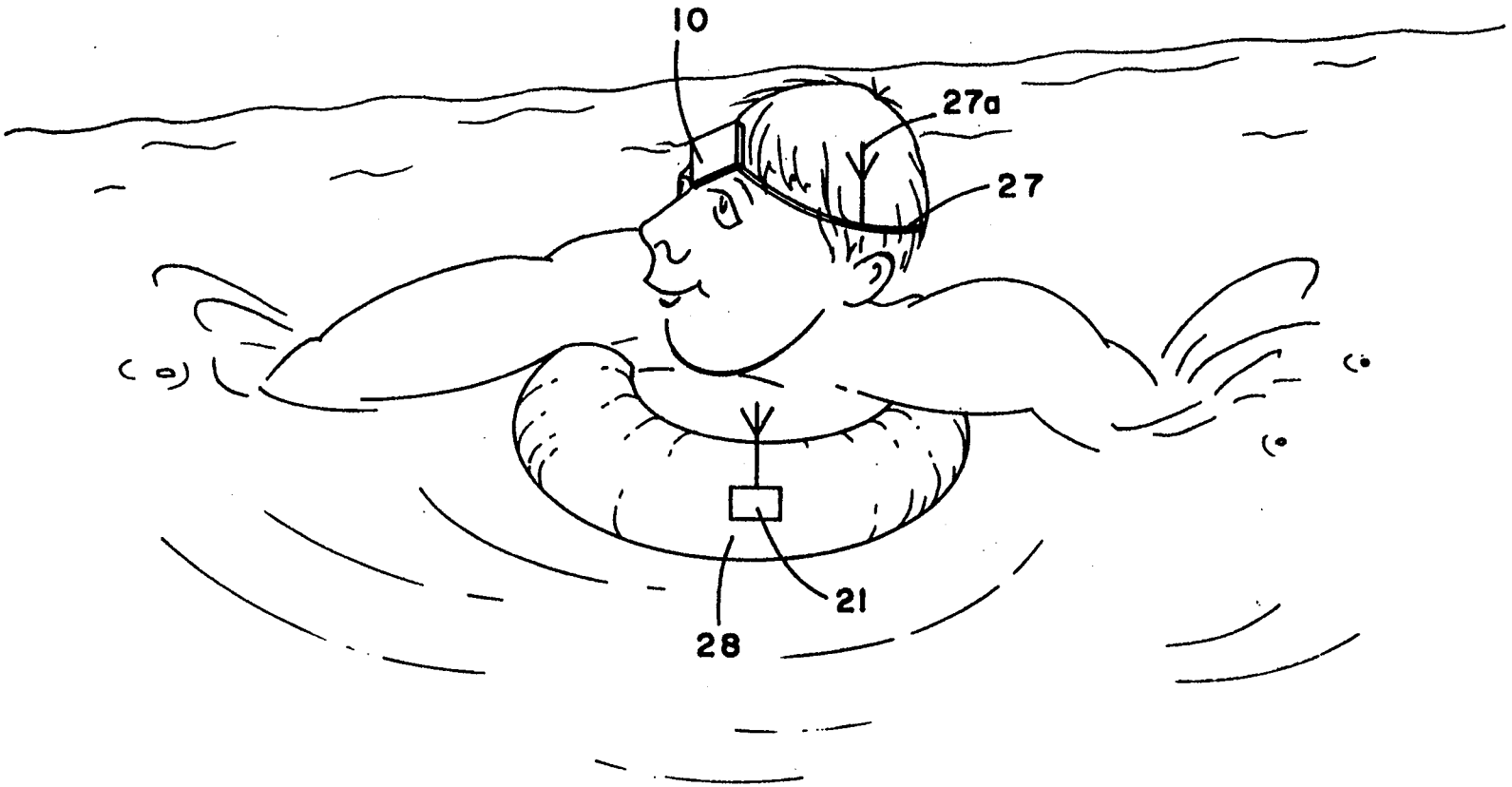
FIG. 6 is a pictorial representation of the float shown in FIG. 5 after being inflated by the device.

FIGS. 5 and 6 show pictorially a third embodiment of the invention wherein the swimmer 26 wears a normally deflated float 28 which is responsive to the warning signal for inflating. Such floats are well known and may be provided with a manually operated pull cord for manually inflating the float. Life jackets operating on this principle are usually provided in aircraft, for example. Typically, inflation occurs as a result of a chemical reaction which produces gases which inflate the float. Electrical operation may be achieved via a suitable transducer so that the float 28 inflates in response to the warning signal. In such case, manual operation may still be achieved by operating the manual switch 18 connected across the timing means 12.

In such an embodiment it is not desirable that the float be electrically coupled to the device 10 by means of an electrical wire. Therefore, a receiver may be mounted on the float for receiving the warning signal transmitted by a transmitter coupled to the device 10. If desired, the warning signal can be transmitted remotely by a life guard if a swimmer disappears from view and the life guard, or other auxiliary, suspects that he may be in danger. By such means, the life guard can induce the swimmer to float to the surface of the pool.

It will be appreciated that, during use, the device 10 will frequently be submerged beneath the water level 25 for short time periods. However, this is of no consequence during normal swimming, since, between strokes, the swimmer 26 will raise his head above the water surface 25, thereby causing the water-sensitive switch 11 to open and reset the timing means 12. Thus, any natural tendency of the head to become submerged beneath the water level consequent to normal swimming is not an impediment to the use of the device.

It will also be appreciated that, particularly for very young children, the device 10 may equally be secured to the child's ankle so as to provide a warning even if he steps into a shallow paddling pool. By such means, the device will alert the child's parents that the child has entered the pool.

It will further be appreciated that, whilst the device has been described with particular reference to its use as a swimming pool alarm, it may also be worn by children, or elderly people, when bathing so as to provide an immediate warning if they become submerged beneath the water level for longer than a predetermined period of time.

We claim:

1. A device for attachment to a part of a person's body for producing a warning signal when a person's head is continuously submerged beneath water for a time longer than a predetermined time interval, the device comprising:

a resettable timing means having first and second terminals and being responsive to a voltage applied to the first terminal for connecting the second terminal to the first terminal after said predetermined time interval and being responsive to an interruption of said voltage on said first terminal for automatically resetting;

a signalling unit connected to the second terminal of the timing means and being responsive to the voltage thereon for producing said warning signal and thereby signaling a continuous interruption of the person's breathing for longer than said predetermined time interval;

a normally open water-sensitive switch for attaching to an upper part of the person's head which is normally above water and being coupled to the first terminal of the timing means; and an electrical supply coupled to the water-sensitive switch for applying said voltage to the first terminal of the timing means when the water-sensitive switch is submerged beneath water;

said voltage being disconnected from the first terminal of the timing means whenever the water-sensitive switch is raised above water thereby automatically resetting the timing means, and said predetermined time interval being less than a danger time during which a person submerged beneath water would drown so that the device discriminates between safe and dangerous immersion of the person's head under water.

2. The device according to claim 1, including a manual switch means connected across the first and second terminals of the timing means for manually operating the signalling unit before said predetermined time interval has elapsed.

3. The device according to claim 1, wherein the signalling unit is part of an alarm unit.

4. The device according to claim 3, wherein the alarm unit provides an audible alarm.

5. The device according to claim 3, wherein the alarm unit provides a visual alarm.

6. The device according to claim 1, wherein:

the person wears a normally deflated float coupled to the signalling unit and responsive to the warning signal produced thereby for inflating automatically when the person is submerged beneath water for longer than said predetermined time interval.

7. The device according to claim 6, including a manual switch means connected across the first and second terminals of the timing means for manually inflating the float before said predetermined time interval has elapsed.

8. The device according to claim 1, wherein the signalling unit comprises:

a transmitter means for transmitting a transmit signal when the first and second terminals of the timing means are connected to each other, a receiver means remote from the transmitter means for receiving the transmit signal and producing a received signal, and a signalling means coupled to the receiver means and responsive to the received signal for producing said warning signal.

9. The device according to claim 8, wherein:

the transmit signal has a frequency in the electromagnetic spectrum, the transmitter means includes an antenna for transmitting the transmit signal to the receiver means, and the antenna is a flexible electrically conductive strap for securing the transmitter means to the person's body.

10. The device according to claim 9, wherein the flexible electrically conductive strap is covered with a decorative material.

11. The device according to claim 8, wherein:

the person wears a normally deflated float coupled to the receiver means and responsive to the receipt signal produced thereby for inflating automatically when the person is submerged beneath water for longer than said predetermined time interval.

12. The device according to claim 11, including a manual switch means connected across the first and second terminals of the timing means for manually inflating the float before said predetermined time interval has elapsed.

13. The device according to claim 1, further including:

a casing for housing the timing means, the signalling unit, the water-sensitive switch and the electrical supply, and a securing means for securing the device to a part of the person's body.

14. The device according to claim 13, wherein the securing means is a headband.

15. The device according to claim 14, wherein the headband is covered with a decorative material.

16. The device according to claim 1, further including a voltage test means coupled to the electrical supply for testing that an output level thereof is no less than said voltage which must be applied to the second terminal of the timing means.

17. The device according to claim 1, wherein the signalling unit comprises:

a plurality of transmitter means each for transmitting a respective transmit signal when the first and second terminals of the timing means are connected to each other, any two of said transmit signals being emitted in mutually different directions, at least one receiver means remote from the transmitter means for receiving one of said transmit signals directed thereto and producing a received signal, and a signalling means coupled to said at least one receiver means and being responsive to the received signal for producing said warning signal.

18. The device according to claim 17, wherein the signalling unit is part of an alarm unit.

19. The device according to claim 18, wherein the alarm unit provides an audible alarm.

* * * * *